US006273769B1

(12) United States Patent
Bell

(10) Patent No.: US 6,273,769 B1
(45) Date of Patent: Aug. 14, 2001

(54) TRANSPARENT THRUST CONE FOR MONITORING OIL LEVEL AND CONDITION IN WATERCRAFT JET PROPULSION SYSTEM

(76) Inventor: Chris W. Bell, 737 N. Straight St., Las Vegas, NV (US) 89110

( * ) Notice: Subject to any disclaimer, the term of this patent is extended or adjusted under 35 U.S.C. 154(b) by 0 days.

(21) Appl. No.: 09/563,642

(22) Filed: May 2, 2000

(51) Int. Cl.[7] ..... B63H 11/00; B63H 21/38

(52) U.S. Cl. ..... 440/38; 440/88

(58) Field of Search ..... 440/38, 88; 116/227, 116/276; 415/118; 416/174, 244 B, 245 A, 245 R; 184/5.1

(56) References Cited

U.S. PATENT DOCUMENTS

| | | | | |
|---|---|---|---|---|
| 2,345,693 | | 4/1944 | Wilson . | |
| 2,756,680 | | 7/1956 | Rütschi . | |
| 2,851,955 | | 9/1958 | Lapp . | |
| 2,920,575 | | 1/1960 | White . | |
| 3,785,706 | * | 1/1974 | Vangalis | 301/108.3 |
| 4,541,808 | * | 9/1985 | Ono et al. | 440/42 |
| 4,595,030 | * | 6/1986 | Yazaki | 137/203 |
| 4,789,363 | * | 12/1988 | Wicklein | 440/2 |
| 5,012,768 | * | 5/1991 | Roschinski | 123/41.49 |
| 5,713,723 | | 2/1998 | Hathaway . | |
| 5,863,229 | * | 1/1999 | Matte | 440/47 |
| 6,105,819 | * | 8/2000 | Ho et al. | 222/78 |
| 6,183,323 | * | 2/2001 | Tanaka et al. | 440/77 |

* cited by examiner

*Primary Examiner*—S. Joseph Morano
*Assistant Examiner*—Andy Wright

(57) ABSTRACT

A transparent device that allows monitoring of the oil level and condition in the water jet propulsion system through means of a visual inspection. A layman can easily perform this inspection, simply by viewing the transparent thrust cone from the rear of the watercraft jet propulsion system, saving the expense and time of disassembly by a professional.

1 Claim, 2 Drawing Sheets

TRANSPARENT THRUST CONE FOR MONITORING OIL LEVEL AND CONDITION IN WATERCRAFT JET PROPULSION SYSTEM

BACKGROUND OF THE INVENTION

This invention pertains to the general field of jet-powered watercraft. Specifically, the invention relates to a method and device for monitoring oil level and condition in the jet propulsion system.

Water jet propulsion systems are becoming increasingly popular. Many skiers, fishers and family boaters realize that water jet propelled craft offer safety, simplicity and diverse utility. The propulsive force of the water jet transfers directly into the water without going through gears, right-angle shafts, or clutches. This translates into less weight, lower cost, lower maintenance and more reliability when compared to standard marine propeller drives. Functionally, a water jet propulsion system, or marine jet drive, is simply a propeller inside a pipe. The propeller operates as a pump impeller or rotor. The propulsion water intake port is typically an opening near the bottom of the hull, which picks up water and delivers it to the jet pump impeller. A grill across the intake port prevents foreign matter from entering the system. Water jet propulsion systems are also available in outboard engine packages for water craft. Simply stated, all marine jet drives function by inhaling water, compressing it, and passing it out a nozzle in the stern. The result is a powerful jet of water that pushes the vessel forward in the water. A water jet propulsion system can operate in just inches of water, as there is no external propeller. Jet driven water craft can skim flats, thread treacherous rocky passages and navigate river shoals. However, a need exists for the monitoring of the oil level and condition to enhance long-term performance of the water jet propulsion system. With this information, a water craft operator could approach, or even exceed, the advertised service life of the water jet propulsion system.

Current thrust cones are made of a nontransparent material. Consequently, troubleshooting is more complicated and time consuming, and can result in unnecessary disassembling of the water jet propulsion system, simply to check the oil level and condition.

The prior technology is deficient in that it requires the user to physically disassemble the jet pump housing in order to check the condition and level of the oil. When this procedure is performed the oil is now exposed to contaminate and should not be reused, which causes further unnecessary expense. Also, there are additional associated expenses with this procedure. This procedure is time consuming and should be performed by a qualified technician. One never knows the condition or level of the oil in the water jet propulsion system without removing the thrust cone. If this inspection is not performed periodically a catastrophic bearing failure can occur in the water jet propulsion system at a very high cost.

SUMMARY OF THE INVENTION

The primary object of the invention is to provide an improved means of monitoring oil level and condition.

Another object of the invention is to provide easy visual access to the oil level and condition.

Another object of the invention is to provide easy inspection of the oil level and condition.

A further object of the invention is to provide means wherein the visual inspection has a increased degree of adjustability of the oil level.

Yet another object of the invention is to provide means of monitoring the oil level and condition without disassembling.

Still yet another object of the invention is to provide a means of preventing bearing failure due to low oil condition.

Other objects and advantages of the present invention will become apparent from the following descriptions, taken in connection with the accompanying drawings, wherein, by way of illustration and example, an embodiment of the present invention is disclosed.

In accordance with the invention, a transparent thrust cone for monitoring the oil level and condition through a visual inspection without any disassembling of the jet propulsion system. Accordingly, the invention allows a fast and easy inspection that can be performed by a layman to prevent catastrophic failures due to low oil conditions in the jet propulsion system.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The disclosed invention relates primarily to an apparatus for monitoring the oil level and condition in the water jet propulsion system of a watercraft vehicle, and more specifically to a personal watercraft vehicle or similarly powered vehicle. Current methods of checking the oil level and condition is to remove the thrust cone from the water jet propulsion system, which requires time consuming disassembly. The new and improved transparent thrust cone allows oil to be monitored without any disassembly simply by means of a visual inspection.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Figure 1:
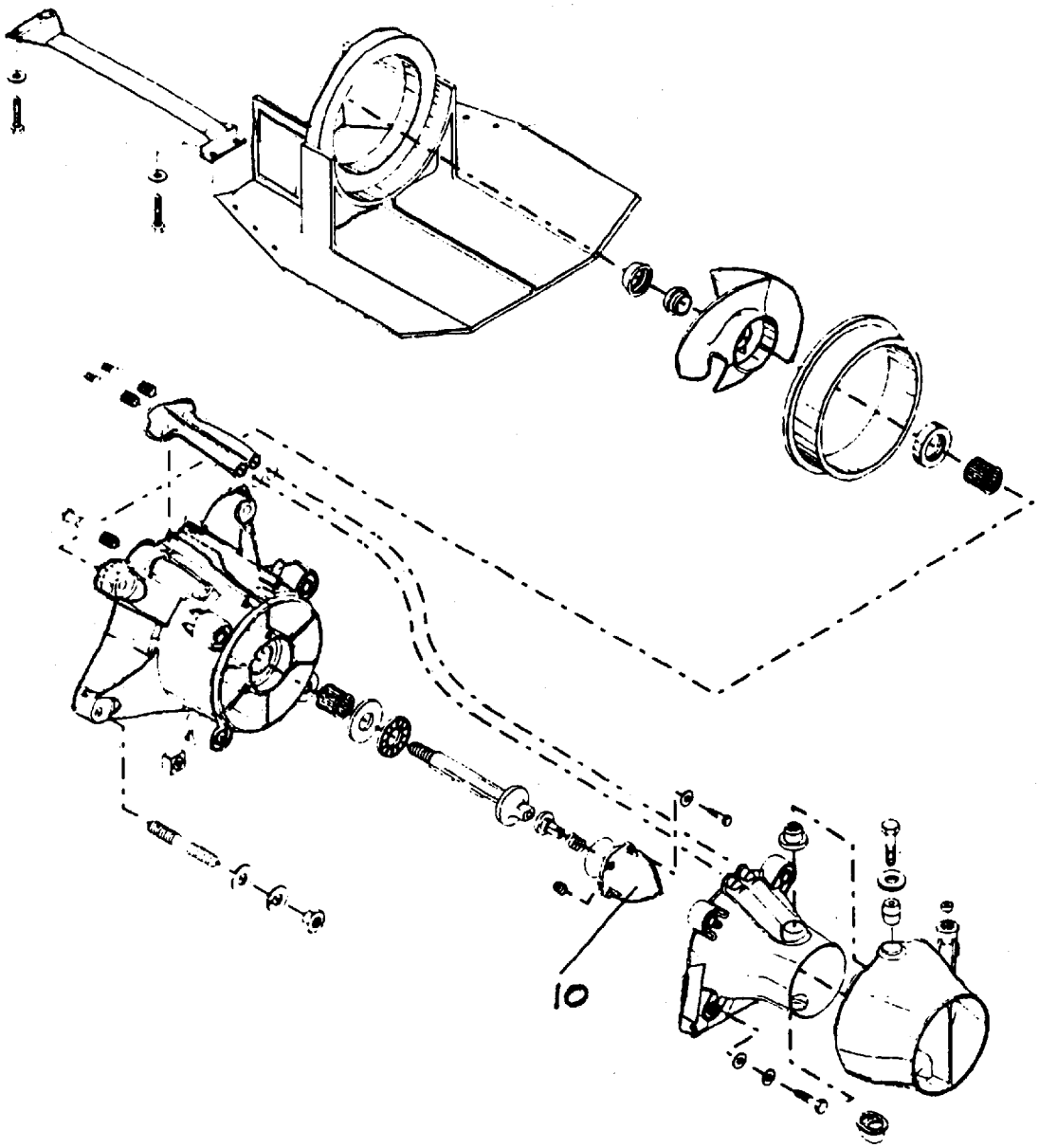
FIG.1 is an exploded perspective view of a conventional jet pump unit and its mounting arrangement within a watercraft vehicle.
Figure 2:
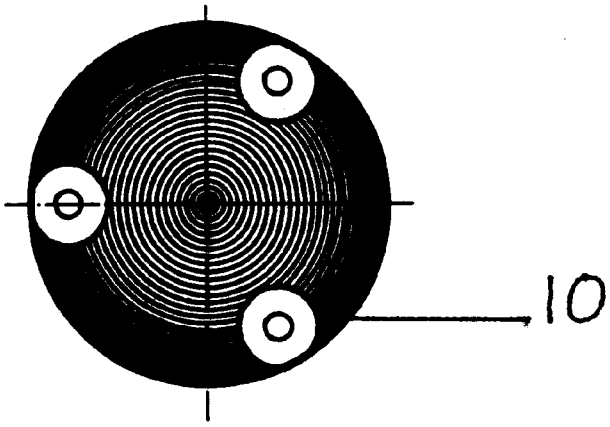
FIG. 2 is a front view of a novel thrust cone.
Figure 3:
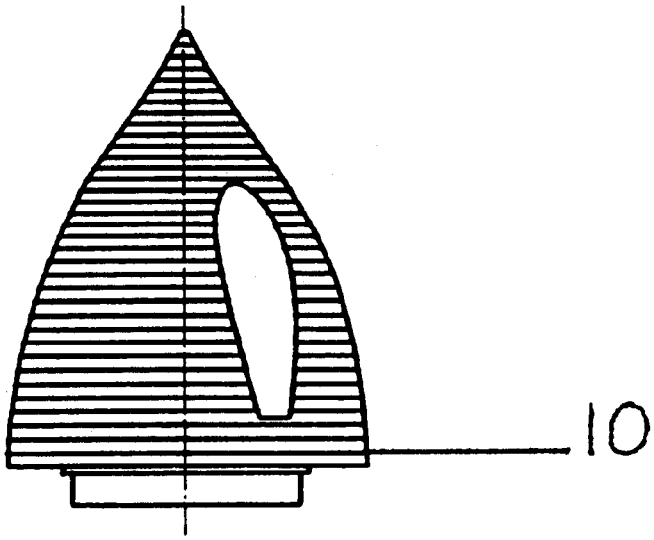
FIG. 3 is a side view of a novel thrust cone.
Figure 4:
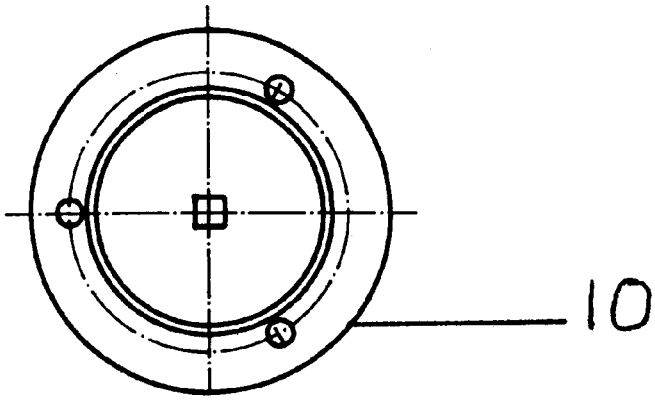
FIG. 4 is a end view of a novel thrust cone.

Referring now to the drawings, FIG. 1 illustrates a thrust cone 10 in a conventional jet propulsion unit for a watercraft vehicle. FIG. 2 illustrates a thrust cone 10 having three mounting holes. FIG. 3 illustrates a thrust cone 10 having one mounting hole shown. FIG. 4 illustrates a thrust cone 10 having three mounting holes.

What is claimed is:

1. A watercraft impeller thrust cone adapted to be attached to a watercraft jet propulsion system, wherein the jet propulsion system comprises a water intake port, a grill across the water intake port, a jet pump impeller, an exit nozzle, and an amount of oil for lubrication purposes, the thrust cone comprising:

a cone shaped member having three mounting holes by which the cone shaped member is attachable to the jet pump impeller, said cone shaped member being transparent such that said amount of oil can be observed without removal of said thrust cone.

* * * * *